US006820290B1

(12) United States Patent
Mullick et al.

(10) Patent No.: US 6,820,290 B1
(45) Date of Patent: Nov. 23, 2004

(54) MOVABLE BATHROOM FIXTURES

(75) Inventors: Abir Mullick, Williamsville, NY (US); Edward Steinfeld, Amherst, NY (US); Drew Kelley, Buffalo, NY (US)

(73) Assignee: The Research Foundation of SUNY at Buffalo, Amherst, NY (US)

( * ) Notice: Subject to any disclaimer, the term of this patent is extended or adjusted under 35 U.S.C. 154(b) by 0 days.

(21) Appl. No.: 09/881,258

(22) Filed: Jun. 14, 2001

Related U.S. Application Data

(60) Provisional application No. 60/211,546, filed on Jun. 14, 2000.

(51) Int. Cl.[7] ..... A47K 4/00
(52) U.S. Cl. ..... 4/663; 4/643; 4/645
(58) Field of Search ..... 4/663, 664, 516, 4/519, 643, 644, 645, 646, 647, 648, 649

(56) References Cited

U.S. PATENT DOCUMENTS

| | | | | |
|---|---|---|---|---|
| 599,706 | A | * 3/1898 | Heineken | |
| 953,857 | A | * 4/1910 | Reynolds | |
| 2,100,568 | A | 11/1937 | Norris | |
| 2,264,082 | A | * 11/1941 | Kintz | |
| 3,230,549 | A | 1/1966 | McMurtrie et al. | |
| 3,555,746 | A | 12/1968 | Geleziunas | |
| 3,530,513 | A | * 9/1970 | Maurer et al. | 4/263 |
| 3,533,200 | A | 10/1970 | Zoebelien | |
| 3,765,139 | A | 10/1973 | Litvin et al. | |
| 4,360,159 | A | 11/1982 | Haynes | |
| 4,424,598 | A | 1/1984 | Cima | |
| 4,457,031 | A | 7/1984 | Moore | |
| 4,653,128 | A | 3/1987 | Canalizo | |
| 4,928,329 | A | 5/1990 | Palmeri | |
| 5,329,651 | A | 7/1994 | Mardero et al. | |
| 5,337,525 | A | 8/1994 | Zaccai et al. | |
| 5,903,937 | A | 5/1999 | Clarke | |
| 6,076,202 | A | * 6/2000 | Lockwood | 4/516 |
| 6,170,096 | B1 | * 1/2001 | Rasmussen | 4/519 |
| 6,360,381 | B1 | * 3/2002 | Fitzgerald, Sr. | 4/645 |

FOREIGN PATENT DOCUMENTS

| | | | | |
|---|---|---|---|---|
| JP | 02282529 | A * | 11/1990 | 4/643 |
| JP | 06000139 | A * | 1/1994 | 4/645 |

OTHER PUBLICATIONS

Merriam Webster's Collegiate Dictionary, Tenth Edition, p. 616.*

Merriam Webster's Collegiate Thesaurus, p. 385.*

* cited by examiner

*Primary Examiner*—Gregory L. Huson
*Assistant Examiner*—Khoa Huynh
(74) *Attorney, Agent, or Firm*—Simpson & Simpson, PLLC

(57) ABSTRACT

A movable bathroom-fixture system, comprising bathroom fixtures modified to allow adjustment of their position in a bathroom; and the means to mount said fixtures on bathroom walls so that the fixture placement is adjustable. The modifiable fixtures include a moveable sink fixture, a moveable shower fixture, a moveable wet wall, a height adjustable toilet seat, and drainage tiles. Depending on the size of the bathroom the modifiable fixtures can be slideably and/or removably attached to moveable wall panel units, moveable walls, moveable panels, or fixture interface units.

3 Claims, 17 Drawing Sheets

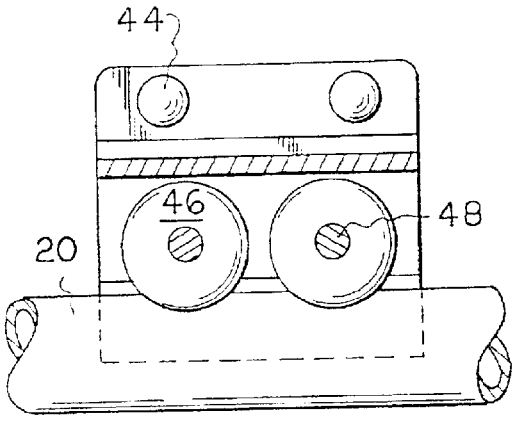
FIG. 8
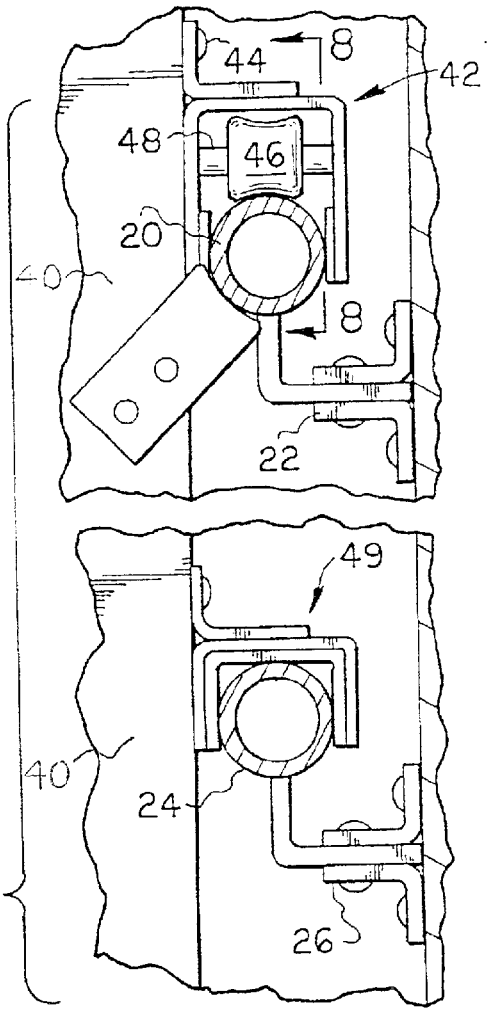
FIG. 6
FIG. 7
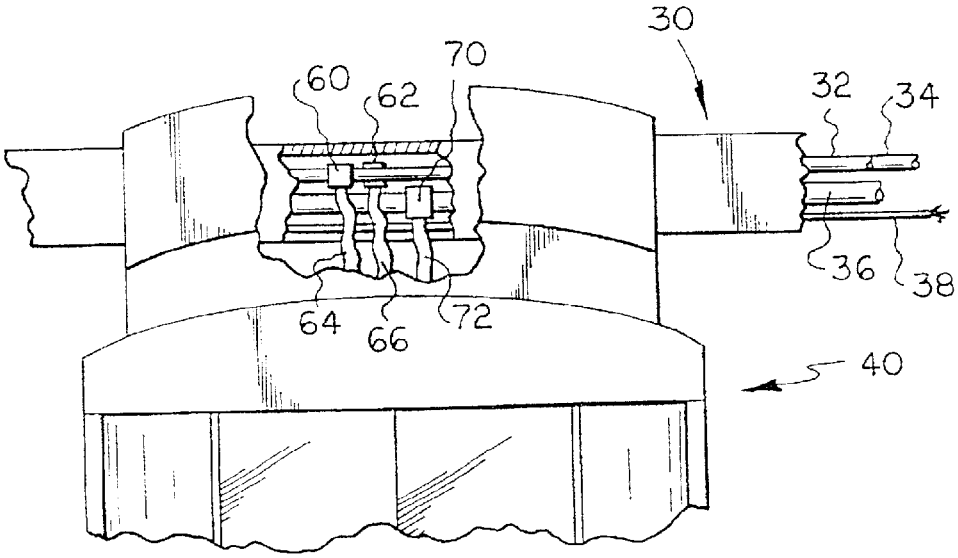

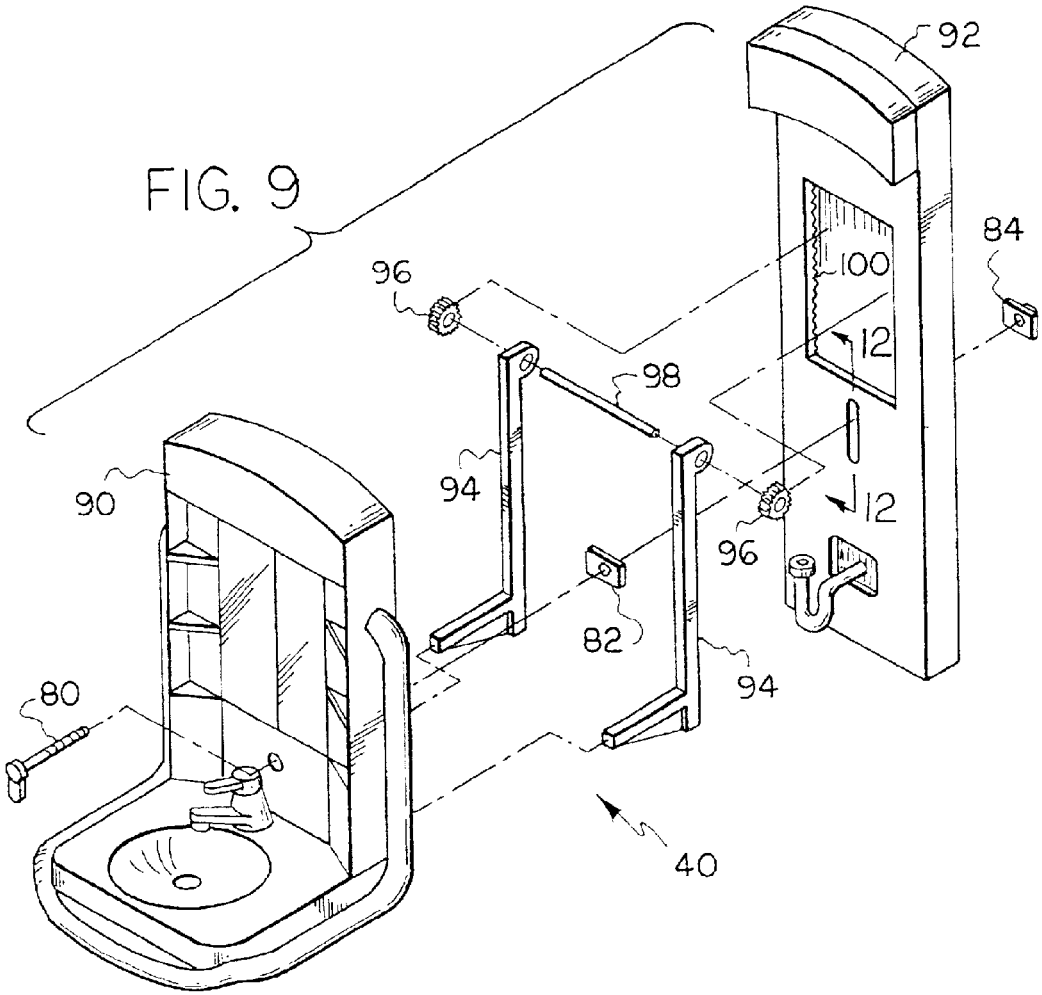
FIG. 9
FIG. 15
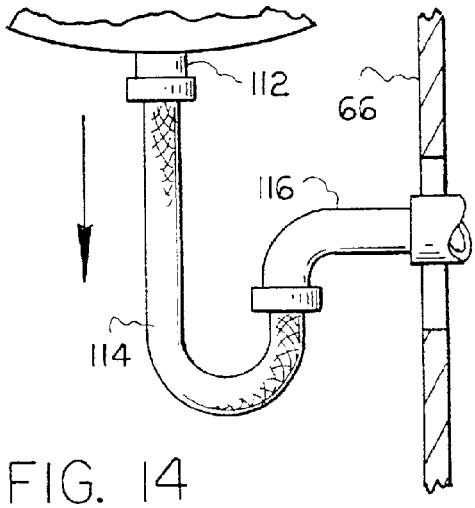
FIG. 14
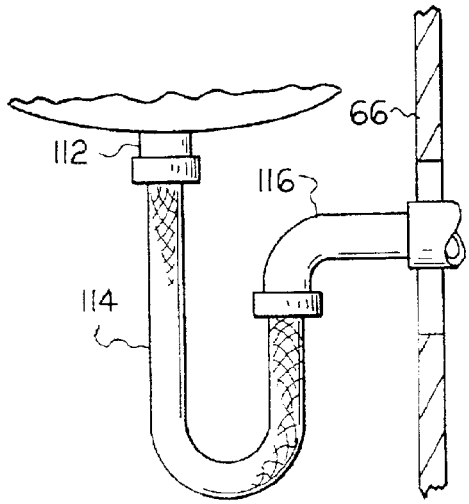

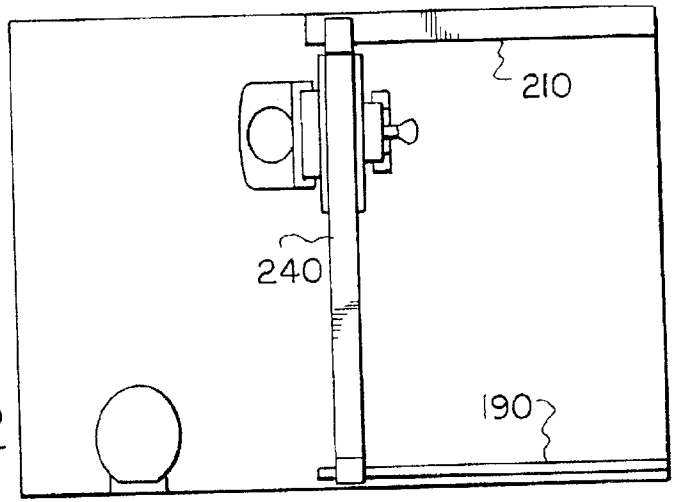
FIG. 22
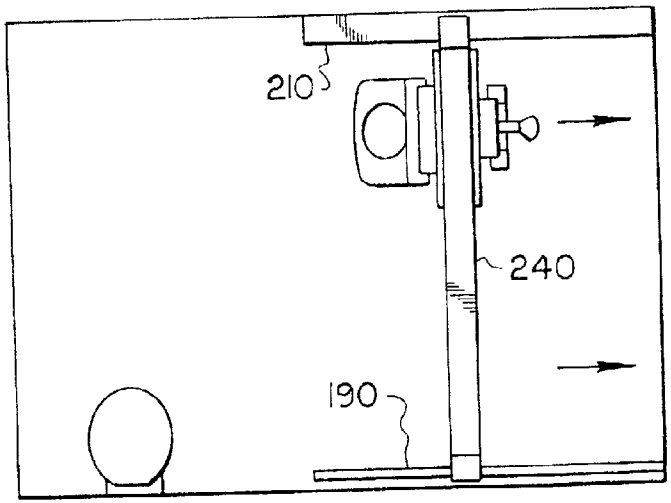
FIG. 23
FIG. 20
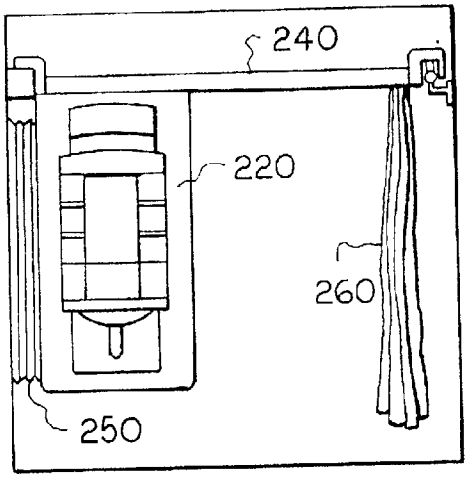
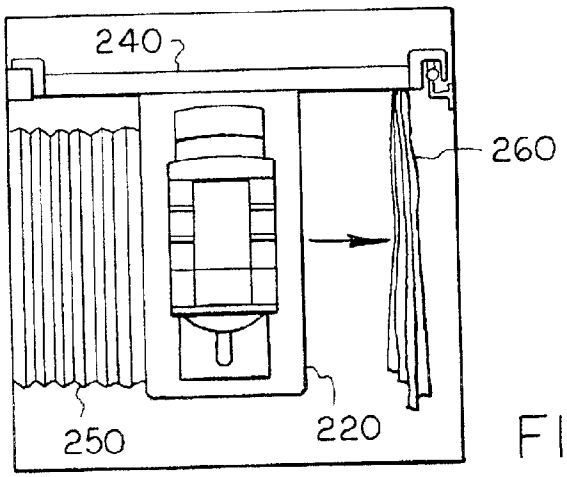
FIG. 21

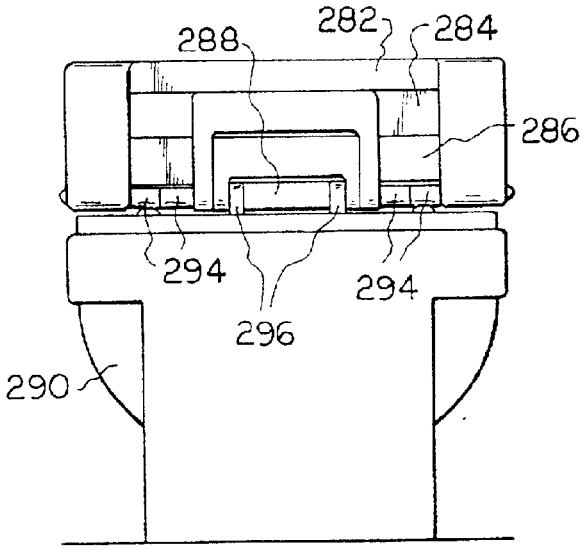
FIG. 33
FIG. 34
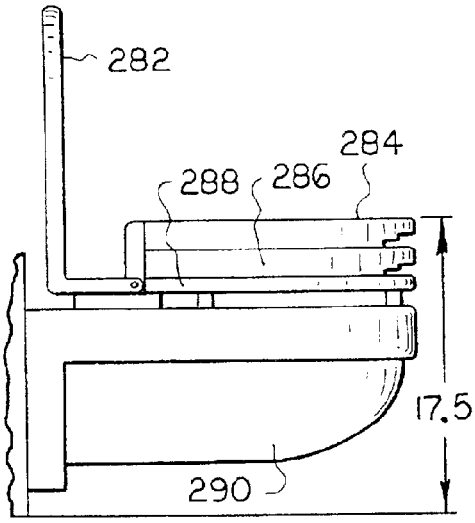
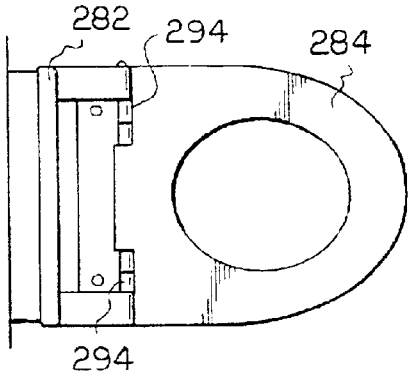
FIG. 35
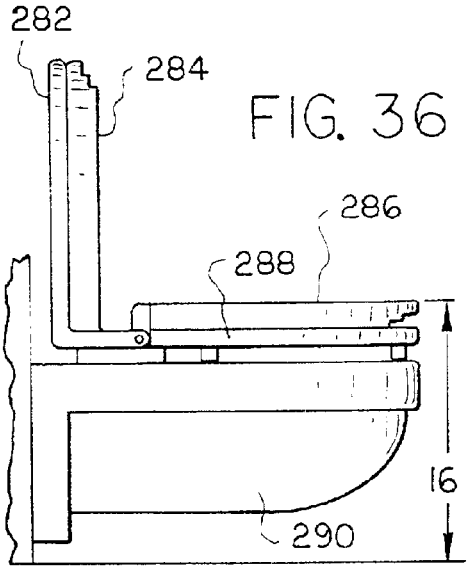
FIG. 36
FIG. 37
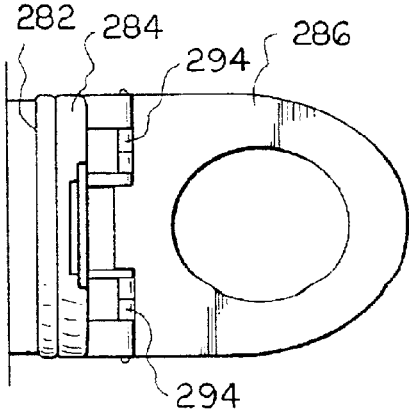

MOVABLE BATHROOM FIXTURES

RELATED APPLICATION

This United States patent application claims the benefit of U.S. Provisional Application Ser. No. 60/211,546, filed Jun. 14, 2000.

FIELD OF THE INVENTION

This invention relates generally to architectural designs, more specifically to bathroom designs, and, even more particularly, to movable bathroom fixtures.

BACKGROUND OF THE INVENTION

Conventional bathrooms are designed so that the typical bathroom fixtures (sinks, walls, showers, toilets, etc.) are permanently secured in place when construction is completed. This means that the placement of these fixtures may suit the first user, but may not be acceptable to subsequent users. Subsequent users may find the design unacceptable for many reasons, including their age, height, physical mobility (or disability), etc. The prior art has, as of yet, failed to appreciate this problem, much less suggest a solution.

U.S. Pat. No. 5,337,525 (Zaccai et al.) discusses flexibility, but only to a narrow extent. This patent discloses a rail system in the bathing area. The rail system allows soap dishes and seats to be positioned around the bathing area, but the size of the bathing area is fixed, and the placement of the showerhead/faucet is fixed as well.

All other prior art patents either use modularity to make construction easier, or modify bathroom fixtures for use by handicapped individuals. In every case, the fixtures are permanently built into the bathroom structure, preventing flexibility.

The following patents all teach modularity: U.S. Pat. No. 3,230,549 (McMurtrie et al.); U.S. Pat. No. 3,533,200 (Zoebelein); U.S. Pat. No. 3,765,139 (Litvin et al.); U.S. Pat. No. 4,653,128 (Canalizo); and U.S. Pat. No. 5,903,937 (Clarke). The context of the modularity in every case is to lower the cost of fabrication, storage, and delivery of the bathroom unit. The object of all these patented inventions is to provide a conventional bathroom at a lower cost. In every case, the bathroom constructed has all the fixtures permanently attached to the walls and/or floor.

U.S. Pat. No. 4,928,329 (Palmeri) discloses modified conventional bathroom fixtures for use by the handicapped. This invention simply replaces permanent conventional fixtures with the permanent handicapped accessible fixtures.

Thus, it is readily obvious that an unmnet, long-felt need continues to exist for a bathroom having fixtures that can meet the variety of needs presented by various users. This need could be met by designing a bathroom having bathroom fixtures that are easily adjusted to suit the needs, or tastes, of a variety of users.

SUMMARY OF THE INVENTION

Accordingly, the present invention comprises five embodiments, each a part of a movable-fixture bathroom. The five embodiments include: movable fixtures, removably securable fixture panels, movable wall fixture units, and fixture interface units. In each of the first four embodiments, the toilet location is fixed. The fixtures that can be moved are the sink, shower, and wet wall. The invention also includes an adjustable toilet embodiment (fifth embodiment).

A primary object of this invention is to provide maximum flexibility in bathroom configuration after construction is finished. This will make the housing unit attractive to the largest number of people, whether they are buying or renting. They will be able to adjust the bathroom to their tastes and needs. This invention also allows multiple people using the same bathroom to each use their preferred arrangement.

Another object of the present invention is to provide movable bathroom fixtures mounted on rails, allowing the fixtures to move horizontally and/or vertically along the walls A further object is to provide horizontally and vertically removably securable fixture panels where each fixture is mounted on the horizontally and vertically removably securable fixture panel that locks into a wall frame.

Still another object of the present invention is to provide movable wall fixture units, where the movable wall fixture unit is a wall suspended on rails with vertically movable fixtures mounted on it.

Still a further object of the present invention is to provide fixture interface units having means for adjusting standard bathroom fixtures that are mounted on the fixture interface unit.

Yet another object of the present invention is to provide an adjustable toilet seat that allows each user to customize the height of the toilet seat.

Yet a further object of the present invention is to provide a floor drain system is designed to allow maximum flexibility in using the floor space, where basins under the floor collect the water from a wide area, then send it down the drain allowing the floor to dry quickly.

These and other objects, features and advantages of the present invention will become apparent to those having ordinary skill in the art upon reading the following detailed description of the invention in view of the claims and drawings.

BRIEF DESCRIPTION OF THE DRAWINGS

FIG. 6 is a cross-sectional view of the support rails and the support brackets on the back of the fixture bases shown in FIG. 2 taken along line 6—6;

FIG. 7 is a front cut out view showing the service connections between the sink base and the supply rail;

FIG. 8 is a cross-sectional view taken along line 8—8 of FIG. 6 showing the rollers of upper support bracket on the back of the fixture base;

FIG. 9 is a perspective exploded view of the sink unit being mounted on the fixture base;

FIG. 14 is side view of the flexible sink drainpipe;

FIG. 15 is a side view of the flexible sink drainpipe after the sink unit has been lowered;

FIG. 20 is an orthographic front view of the movable wall fixture unit with the fixture panel up against the left wall;

FIG. 21 is an orthographic front view of the movable wall fixture unit, showing a divider connected between the fixture panel and the left wall unfolding as the fixture panel is rolled horizontally along the beam;

FIG. 22 is an orthographic top view of the movable wall fixture unit positioned at the end of the support rails;

FIG. 23 is an orthographic top view of the movable wall fixture unit showing the wall rolling on the support rails towards the back of the room;

FIG. 33 is an orthographic back view of the adjustable toilet seat with the cover down;

FIG. 34 is an orthographic side view of the adjustable toilet seat with the cover up;

FIG. 35 is an orthographic top view of the adjustable toilet seat with the cover up;

FIG. 36 is an orthographic side view of the adjustable toilet seat with the first seat up, FIG. 37 is an orthographic top view of the adjustable toilet seat with the first seat up;

DETAILED DESCRIPTION OF THE PREFERRED EMBODIMENT

Figure 1:
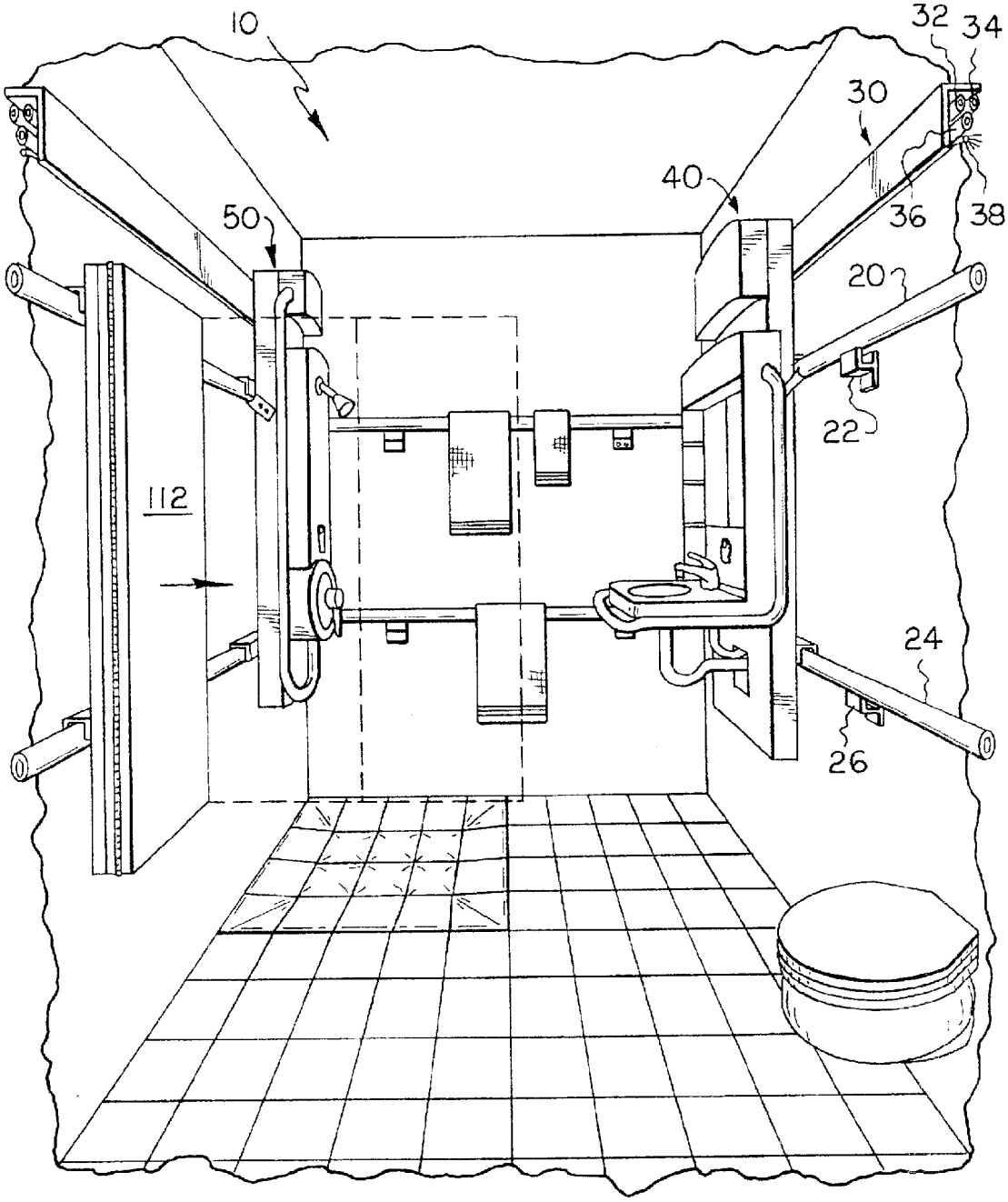
FIG. 1 is a perspective view of the first embodiment of the invention, movable fixtures.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification, and are to be construed as a portion of the entire "written description" of this invention, as required by 35 U.S.C. §112. As used in the following description, the terms "right," "left," "up," "down," "vertically" and "horizontally" (and derivatives thereof), refer to the orientation of the illustrated structure as the particular drawing figures face the reader, except as otherwise noted.

For purposes of this patent, the terms appearing below in the description and in the claims are intended to have the following meanings:

"Wet wall" refers to a wall that is used to contain splashing water, such as the water that splashes out from a shower. In other words, a "wet wall" separates an area of a room intended to "get wet" from an area intended to be kept dry. It should be noted that the wet wall described below serves the same function as a shower curtain, i.e., privacy and splash protection. In addition, the wet wall can also be used to hold a mirror, towels, or other bathroom accessories. The wet wall is also meant to function as a room divider to divide the bathroom into a shower or dressing area and the toilet and sink area, for example.

"Handicapped" refers to individuals who are physically challenged or disabled.

The present invention comprises five embodiments related to movable and/or adjustable bathroom fixtures. These include: movable fixtures, removably securable fixture panels, movable wall fixture units, and fixture interface units. In each of these four embodiments, the toilet location is fixed. The fixtures that can be moved are the sink, shower, and wet wall. The invention also includes a fiflh embodiment comprising an adjustable toilet embodiment.

The movable fixtures embodiment comprises bathroom fixtures mounted on rails, allowing them to move horizontally and/or vertically along the walls.

The removably securable fixture panels embodiment comprises fixtures mounted on a panel that locks into the wall frame. Blank tiles cover the wall frame not covered by the fixtures. When changes are desired, the blank tiles are removed from the new location. The fixture panel is disconnected from the utility supplies. Then, the fixture panel is moved to its new position and hooked back up to the utility supplies. Finally, the tiles are replaced over the old position of the fixture panel. Vertical adjustment is possible by moving the entire panel up or down, or by moving the fixture vertically with respect to the panel.

The movable wall fixture unit embodiment comprises a wall suspended on rails with the fixtures mounted on it. Moving the wall on the rails changes the spatial relationships between the fixtures and the rest of the room. The fixtures can be adjusted vertically on the wall that is horizontally movable.

The fixture interface units embodiment provides means to make standard bathroom ilo fixtures adjustable. In this embodiment, standard bathroom fixtures are mounted on fixture interface units that allow the fixture to be adjusted on the wall.

The adjustable toilet seat allows each user to customize the height of the toilet seat. The seat height can be changed easily by subsequent users to suit their preference and body characteristics (e.g., a lower seat can be used by a child, and a higher seat can be used by an adult).

The floor drain system is designed to allow maximum flexibility in using the floor space. The drainage tiles span a much wider area than a conventional floor drain. Basins under the floor collect the water from a wide area, then send it down the drain. This allows shower water to drain faster, allowing the floor to dry more quickly than does a conventional shower floor. This allows most of the floor to be used as shower space when showering, without preventing others (who need a dry floor) from using the bathroom.

The vertical adjustment of fixtures allows users of different heights, especially children or shorter adults, to have the fixtures at their desired level. All the embodiments provide this flexibility.

The horizontal adjustment of fixtures is important to meeting the stated objective. Individuals in wheelchairs have a difficult time navigating a conventional bathroom unless it is very large. The horizontal movement allows users to move all other fixtures away from the one they are currently using. With the sink and shower moved away, the toilet is much easier to operate. The sink can be moved over the toilet, leaving almost the entire bathroom space for showering. This feature makes the bathroom seem much bigger, as each fixture can be isolated kilo from the others.

Instead of making a conventional sized bathroom seem bigger, a smaller area than a conventional bathroom could be built. The movable fixtures or wall embodiments could be gyp installed in this smaller space, saving room in the rest of the building. These embodiments could also be installed in rooms that are too small to be handicapped accessible as conventional bathrooms, making them accessible to everyone.

The adjustability can also be used to move the fixtures closer together if desired. For example, the movable fixture embodiment allows a user to move the sink into the shower area. The fixtures can be used differently than in a conventional bathroom because of their mobility. This ability to use the fixtures together makes them more useful than conventional fixtures.

Instantaneous adjustment of vertical levels is possible with the first and third embodiments, movable fixtures and movable wall fixture unit. Instantaneous adjustment may be necessary for a bathroom shared by several users with different preferences and needs.

If instantaneous adjustment is not necessary, the second embodiment, removably securable fixture panels, can be used. The bathroom can be set up to accommodate individual users, and can be adjusted, but with more work than with movable fixtures and wall. The removably securable fixture panels embodiment looks more like a conventional bathroom than the other two embodimnents, and with only one user instantaneous adjustment may not be needed.

Fixture interface units allow conventional bathrooms to be modified quickly to provide some flexibility, but will not provide as much flexibility as the first three embodiments.

In brief, this invention provides flexibility in bathroom design to meet the requirements of a variety of users. It allows a bathroom to be handicapped accessible, without specializing the fixtures for the handicapped. It allows a builder or land/ord to install bathroom fixtures that will be accessible and beneficial to all potential residents.

Adverting now to the drawings, FIG. 1 is a perspective view of the first preferred embodiment of the invention, movable fixtures 10. The bathroom fixtures that are movable in this embodiment include sink fiture 40, shower fixture 50, and wet wall fixture 112. It should be appreciated, however, that although only three bathroom fixtures are illustrated as being movable in this embodiment, one having ordinary skill in the art can readily imagine that the concept of this invention may be applied to other bathroom fixtures as well. The general concept of this invention is to provide a means and method for moving these fixtures to accommodate a variety of individual requirements and tastes.

Movable sink fixture 40 is secured to a fixed wall of the bathroom by rails 20 and 24, respectively. Upper support rail 20 is secured to the walls of the bathroom with brackets 22 around the walls of the room. Lower support rail 24 is connected to the wall with brackets 26 around the walls of the room. In the preferred embodiment, rails 20 and 24 would be coated with a material such as Teflon to minimize friction. Supply rail 30 is located above rail 20. Supply rail contains four lines: the hot water supply 32, the cold water supply 34, the water return 36, and electrical supply 38. Sink fixture 40 is shown slidably supported by rails 20 and 24. The sink fixture's connection to supply rail 30 is not shown in FIG. 1.

FIG. 7 is a front cut-out view of the connection between sink fixture base 92 and supply rail 30 to provide an example of a connection between a fixture base and supply rail 30.

Figure 4:
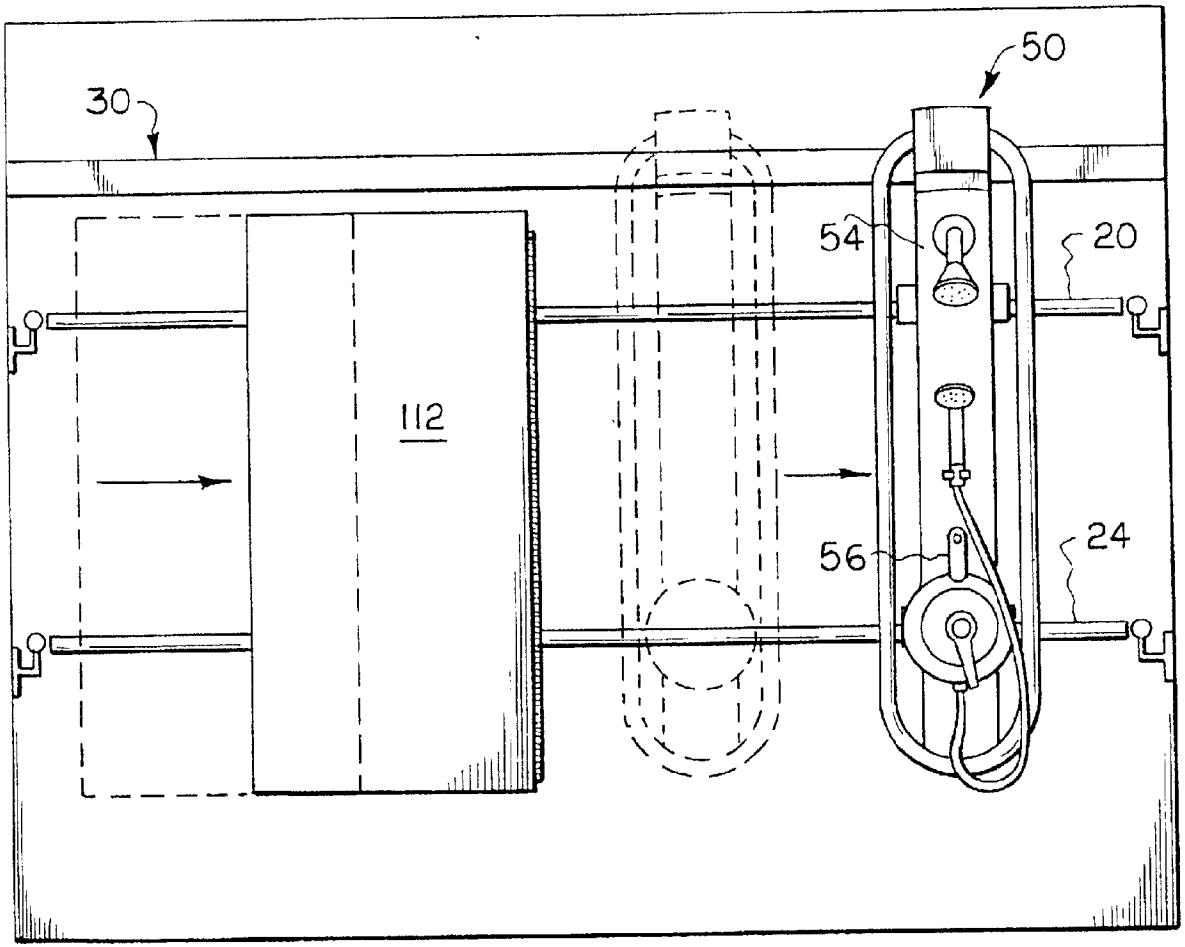
FIG. 4 is an orthographic front view of the wet wall being unfolded and moved toward the shower fixture and the shower fixture being moved horizontally on the support rails.

FIG. 1 shows shower fixture 50 slidably supported by rails 20 and 24 on the wall opposite to sink fixture 40. When the shower is in use, wet wall 112 can be positioned near the showerhead and then unfolded, as indicated in FIG. 1, to provide privacy and to keep the water from the shower in the vicinity of the showerhead. FIGS. 1 and 4 show wet wall 112 hanging on rails 20 and 24.

Figure 3:
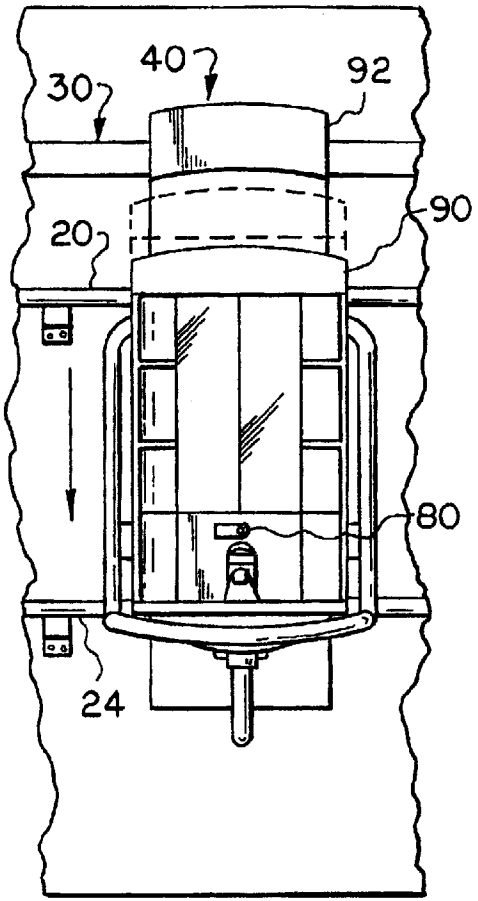
FIG. 3 is an orthographic front view of the sink unit being moved vertically with respect to the fixture base.
Figure 2:
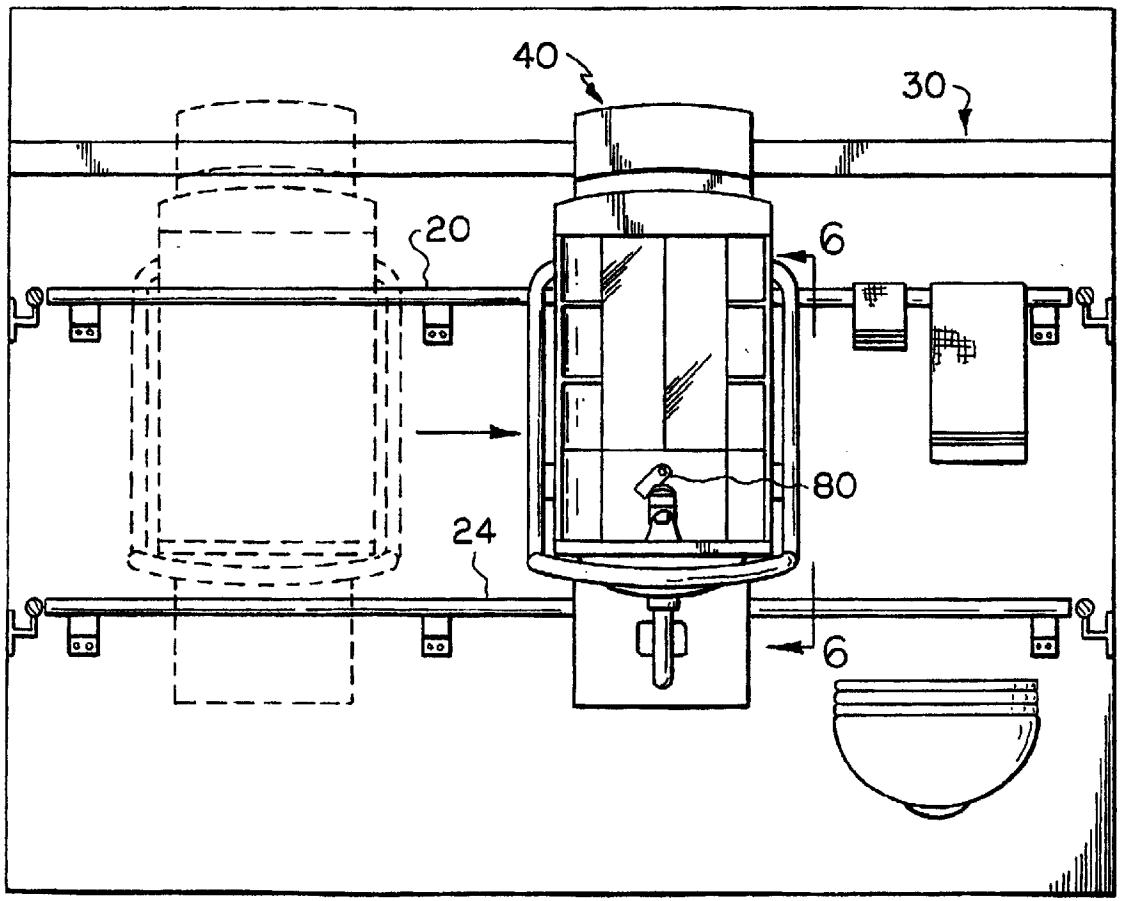
FIG. 2 is an orthographic front view of the sink fixture being moved horizontally on the support rails.
Figure 12:
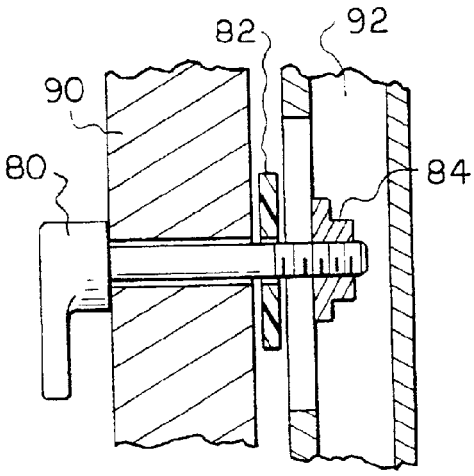
FIG. 12 is a cross-sectional view taken along line 12—12 of FIG. 9 showing the securing bolt used to secure the sink unit in place on the fixture base.
Figure 13:
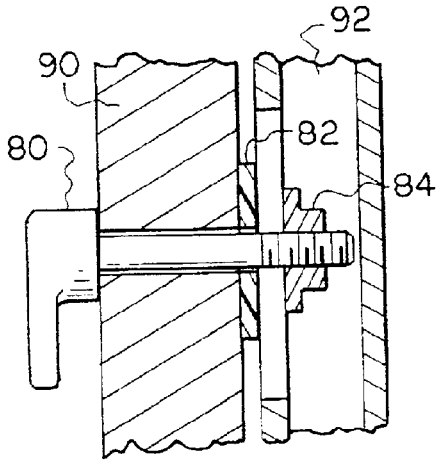
FIG. 13 is a cross-sectional view taken along line 12—12 of FIG. 9 showing the securing bolt used to secure the sink unit on the fixture base.

FIGS. 2 and 3 show the adjustment features of sink fixture 40. In FIG. 2, sink fixture 40 is shown moving horizontally on rails 20 and 24. In FIG. 3, the sink unit 90 is moved vertically with respect to the fixture base 92. Unit 90 can be adjusted in height when the securing bolt 80 is loosened, as is illustrated in FIGS. 12 and 13.

FIG. 4 illustrates the adjustment features of shower fixture 50 and wet wall 112. In FIG. 4, shower fixture 50 is shown moving horizontally on rails 20 and 24. Wet wall 112 is mounted so it, too, can be rolled along rails 20 and 24. Wet wall 112 is movable to allowthe user to adjust the size of the showering area. In the preferred embodiment, mirrors are mounted on the side of the wet wall facing away from the shower.

Figure 5:
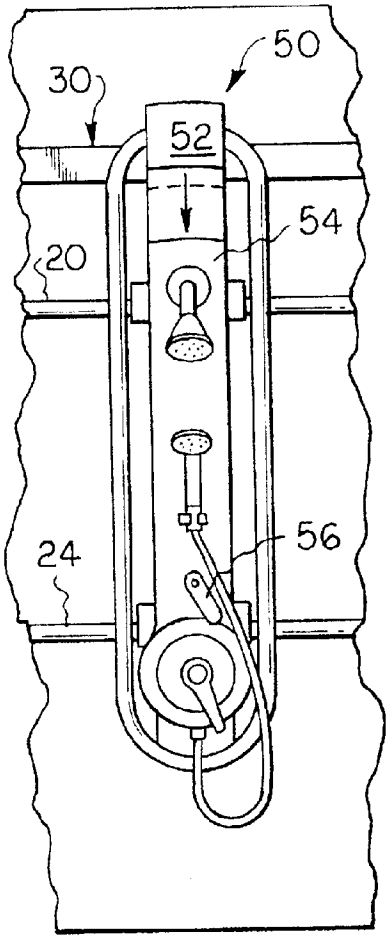
FIG. 5 is an orthographic front view of the shower unit being moved vertically with respect to the fixture base.

In FIG. 5, shower unit 54 is moved vertically with respect to fixture base 52. Unit 54 can be adjusted in height when securing bolt 56 is loosened, similar to sink unit bolt 80 shown in FIGS. 12 and 13. Being able to increase or decrease the dimensions of the shower area and to position the fixtures means that a bathroom can require less space. The majority of the bathroom space can be dedicated to shower use when showering. When finished showering, the user can fold up wet wall 112 and move shower fixture 50 to minimize the amount of space they require when they are not in use.

FIG. 6 is a cross-sectional view of upper and lower support rails 20 and 24, respectively, and upper and lower support brackets 42 and 49, respectively, that are on the back of the fixture bases 92 referenced in FIG. 3, taken along line 6—6 of FIG. 2. Bracket 42 is connected to fixture 40 by rivets 44 as shown in FIG. 6. Horizontal movement of sink fixture 40 along support rail 20 is enabled by rollers 46 (which, because of lack of perspective in FIG. 6, only one roller is visible). FIG. 8, which is a cross-sectional view of upper support bracket 42 on the back of sink fixture base 92, as shown in FIG. 6 taken along line 8—8, illustrates rollers 46 seated on rail 20 to rotate around roller axles 48.

The various service connections that extend between rail 30 and sink fixture 40 are shown in FIG. 7. Hot water supply line 32 has at least one connection valve 60 along its length. Cold water supply line 34 has at least one connection valve 62 along its length. Sink fixture hot water supply line 64 is plugged into valve 60 to provide hot water to sink fixture 40. Sink fixture 40 cold water supply line 66 is plugged into valve 62 to provide cold water to fixture 40. Water return line 36 has at least one connection valve 70 along its length. Fixture water return 72 is plugged into valve 70 to discharge water used by fixture 40.

FIG. 9 shows vertical moving means attached to unit 90 to move unit 90 vertically with respect to the wall. The means for vertically moving the unit 90 comprise support brackets 94 mounted on unit 90, each support bracket 94 having an aperture at the top through which rod 98 is inserted and gears 96 mounted on each end of rod 98, on the outsides of brackets 94. Gears 96 are meshed with teeth 100 mounted on base 92.

Figure 10:
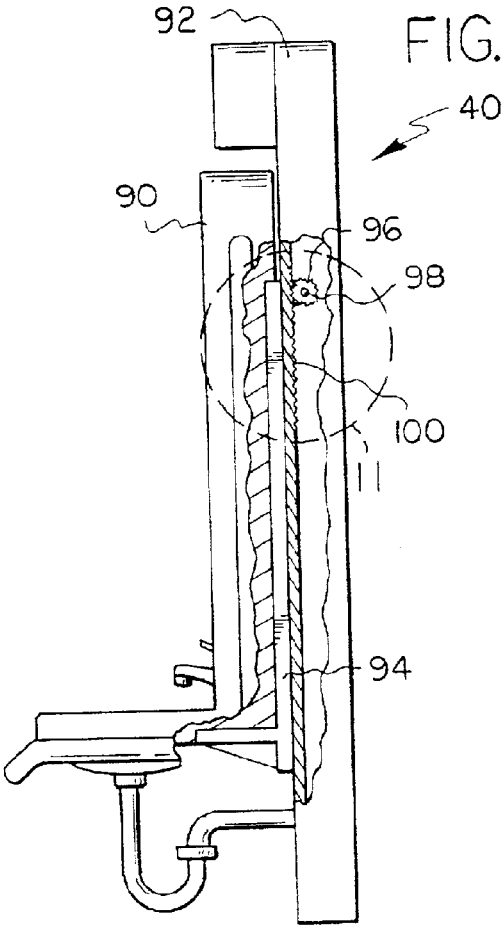
FIG. 10 is a side view of the sink fixture with a cutaway showing the bracket the sink is mounted on and the gear used to raise and lower the sink unit.

FIG. 10 is a cutaway side view of the sink fixture showing unit 90 mounted on bracket 94 and gear 96 used to raise and lower the sink unit.

FIGS. 12 and 13 are cross-sectional views of securing bolt 80 taken along line 12—12 of FIG. 9. Securing bolt 80 is used to secure sink unit 90 onto fixture base 92. Securing bolt 80 is threaded through securing nut 84 such that unit 90 is pinned to base 92. Washer 82 is positioned between unit 90 and base 92. FIG. 12 shows bolt 80 loosened so that unit 90 has freedom to move vertically. FIG. 13 shows bolt 80 tightened, holding unit 90 in place vertically. The vertical adjustability allows different users to change the fixtures to suit their height or preference.

Figure 11:
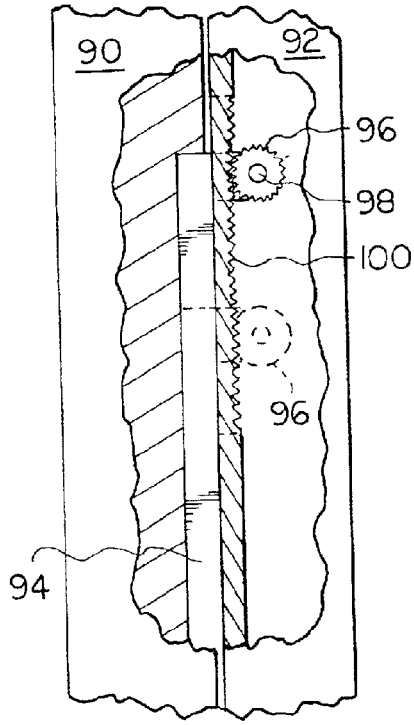
FIG. 11 is a side view with a cut-out showing the gear used to raise and lower the sink unit on the fixture base.

FIG. 11 is a close-up cutaway side view showing how gear 96 is used to raise and lower sink unit 90 on fixture base 92. When bolt 80 is loosened, unit 90 has freedom to move vertically as gears 96 run along teeth 100.

FIG. 14 is side view of the flexible sink drainpipe showing flexible hose 114 connected between sink drain 112 and fixture base drain 116. Drain 116 is connected to fixture water return line 66. Hose 114 allows the sink fixture unit to be moved, as shown in FIGS. 14 and 15.

FIG. 15 is a side view of the flexible sink drainpipe after the sink unit has been lowered showing hose 114 bending to allow the sink fixture unit to be in a lower position.

Figure 16:
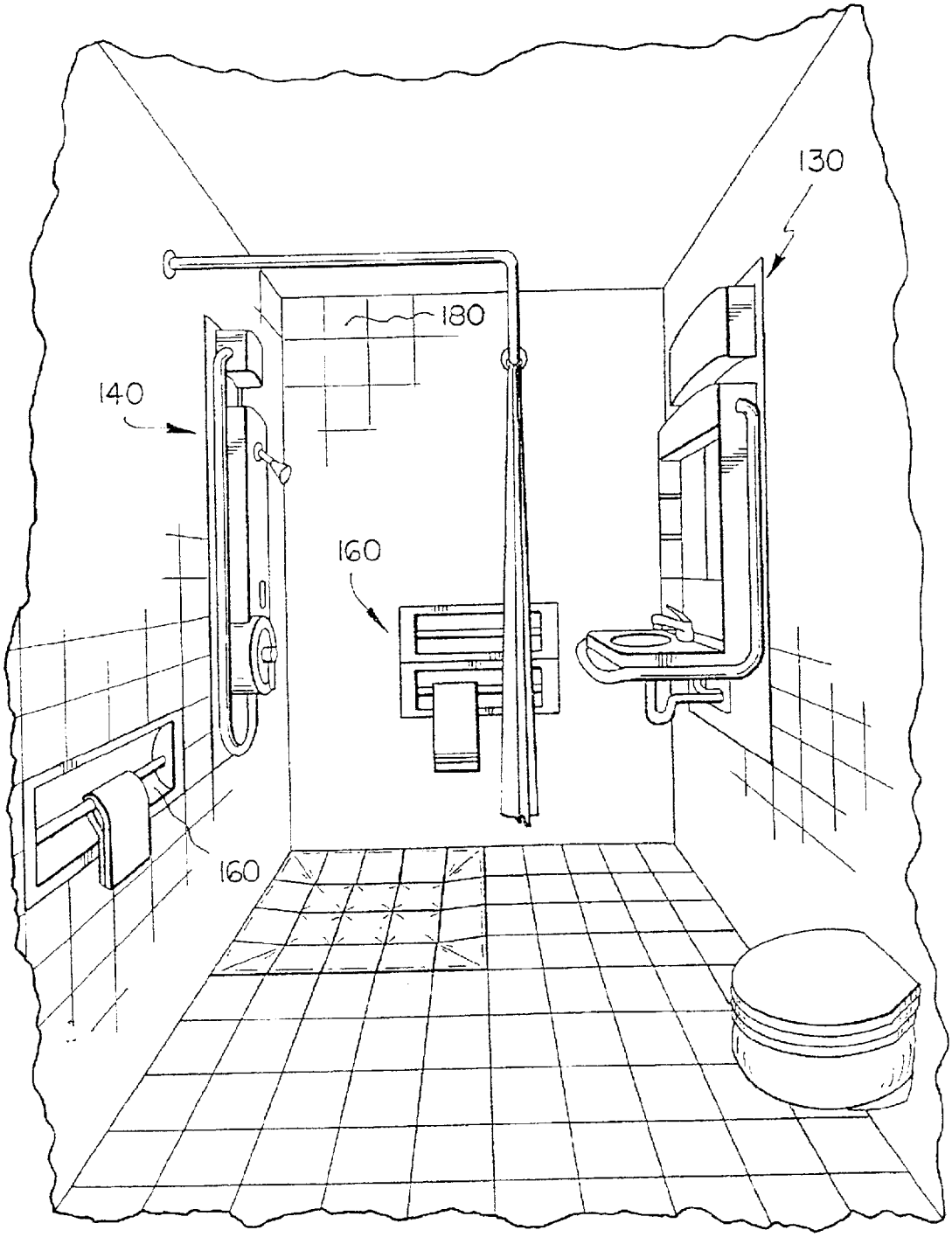
FIG. 16 is a perspective view of the second embodiment, removably securable fixture panels.

A bathroom constructed using the second embodiment is shown in perspective view in FIG. 16. In the second embodiment, the bathroom fixtures are affixed to removably securable fixture panels, where each such removably securable fixture panel is installed in a frame. FIG. 16 shows sink panel 130, shower panel 140, storage panels 160, and movable tiles 180. The fixture panels (sink 130, shower 140, and storage panels 160) are installed in a frame in desired places and tiles 180 are used to fill in the remaining wall space. FIG. 16 shows all the space filled in by fixture panels and tiles, hiding frames 190 that can be seen in FIG. 17.

Figure 17:
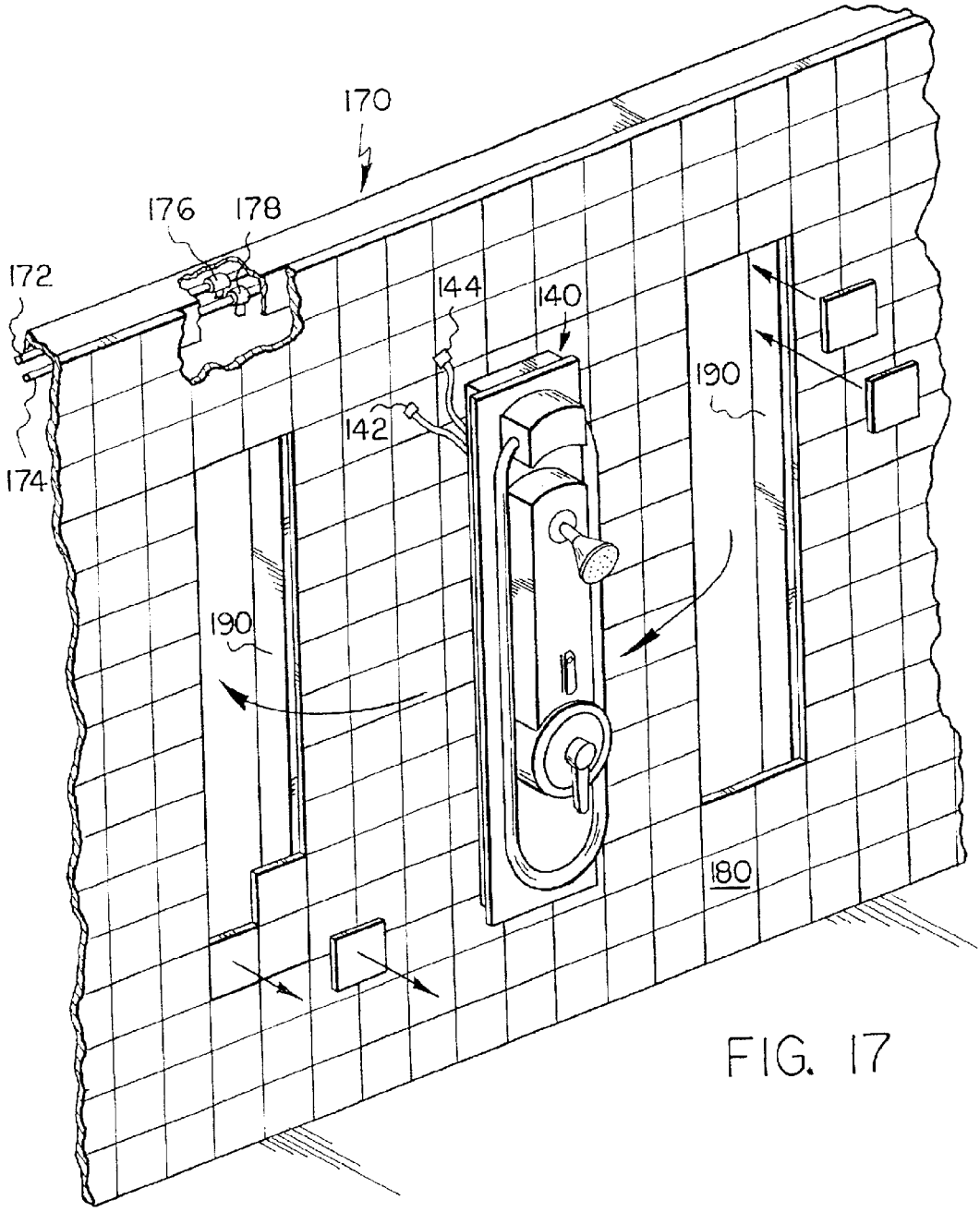
FIG. 17 is a perspective view of the shower panel being moved to a different place on the wall.

FIG. 17 is a perspective view of the shower panel being moved to a different place on the wall; frames 190. The design of the fixture panels allows each the fixtures to be moved to a different place on the wall, as desired. FIG. 17 shows shower panel 140 being moved from the right end of the wall to the left end. Frame 190 is visible where shower panel 140 was removed on the right, and where tiles 180 were removed on the left. Shower panel 140 has water line hookup 142 for hot water and 144 for cold water. Lines 142 and 144 connect to the supply rail 170 that runs around the top of the frame. Rail 170 contains the hot water supply 172 and cold water supply 174. Hot water supply 172 has connection valves 176 every sixteen inches. Cold water supply 174 has connection valves 178 every sixteen inches. This allows lines 142 and 144 to reach a set of connection valves 176 and 178 wherever panel 140 is placed on the wall. Tiles 180 that were removed from frame 190 on the left to make space for panel 140 are connected to frame 190 on the right where panel 140 was removed.

Figure 18:
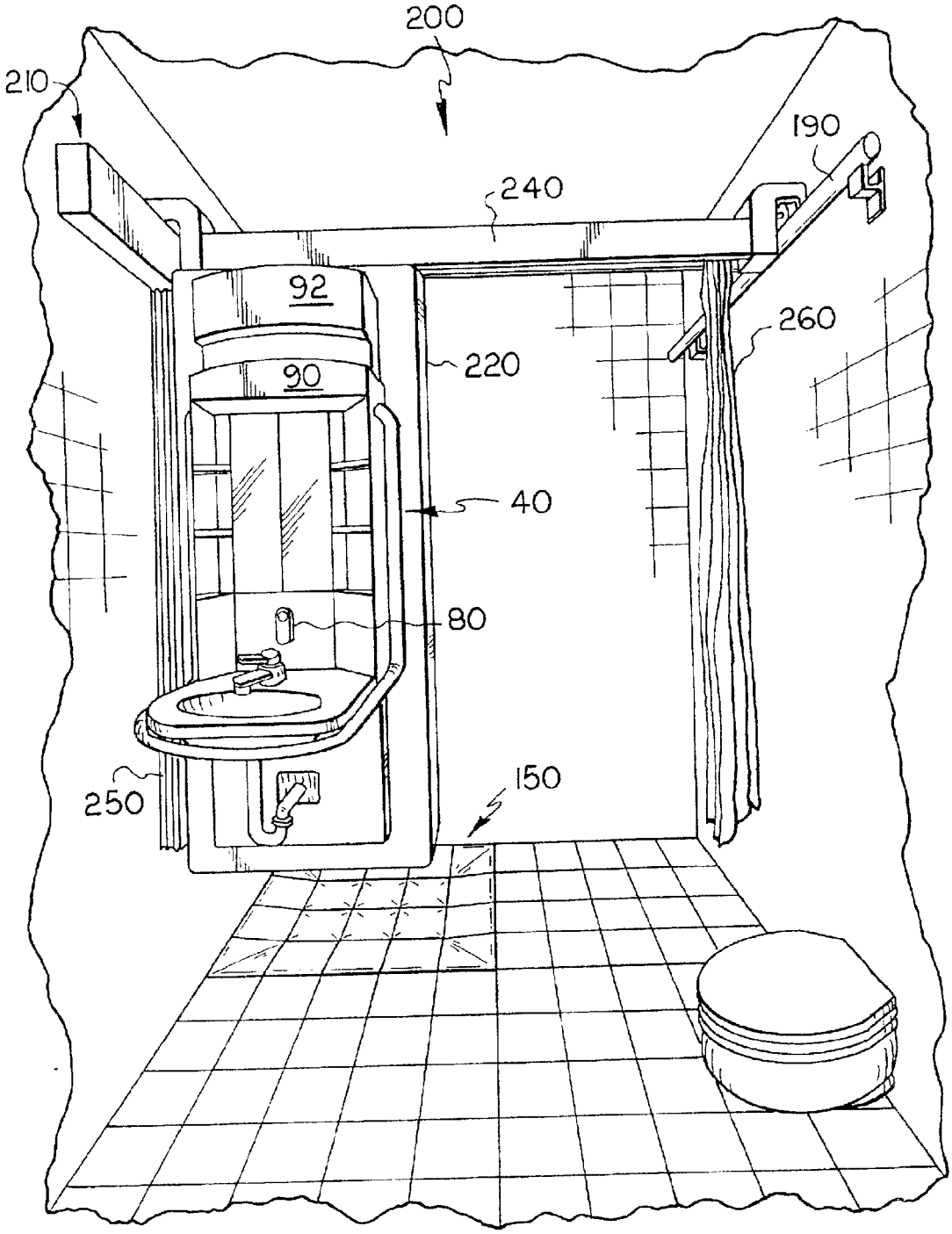
FIG. 18 is a perspective view of the third embodiment, movable wall fixture unit. A sink is mounted on the visible side of the movable wall fixture unit.

FIG. 18 is a perspective view of the third embodiment, movable wall fixture unit, generally indicated by 200. A sink is mounted on the visible side of movable wall fixture unit 200. Movable wall fixture unit 200 is mounted on support rail 190 and supply rail 210. Movable wall fixture unit 200 consists of support beam 240, fixture panel 220, folding divider 250, and shower curtain 260. Fixture panel 220 has sink fixture 40 mounted on its front side and shower fixture 50 mounted on its back side (shown in FIG. 19). Sink unit 90 can be adjusted vertically by loosening securing bolt 80, in the same manner as the sink fixture in the first embodiment. When the sink fixture is at the desired level bolt 80 is retightened.

Figure 19:
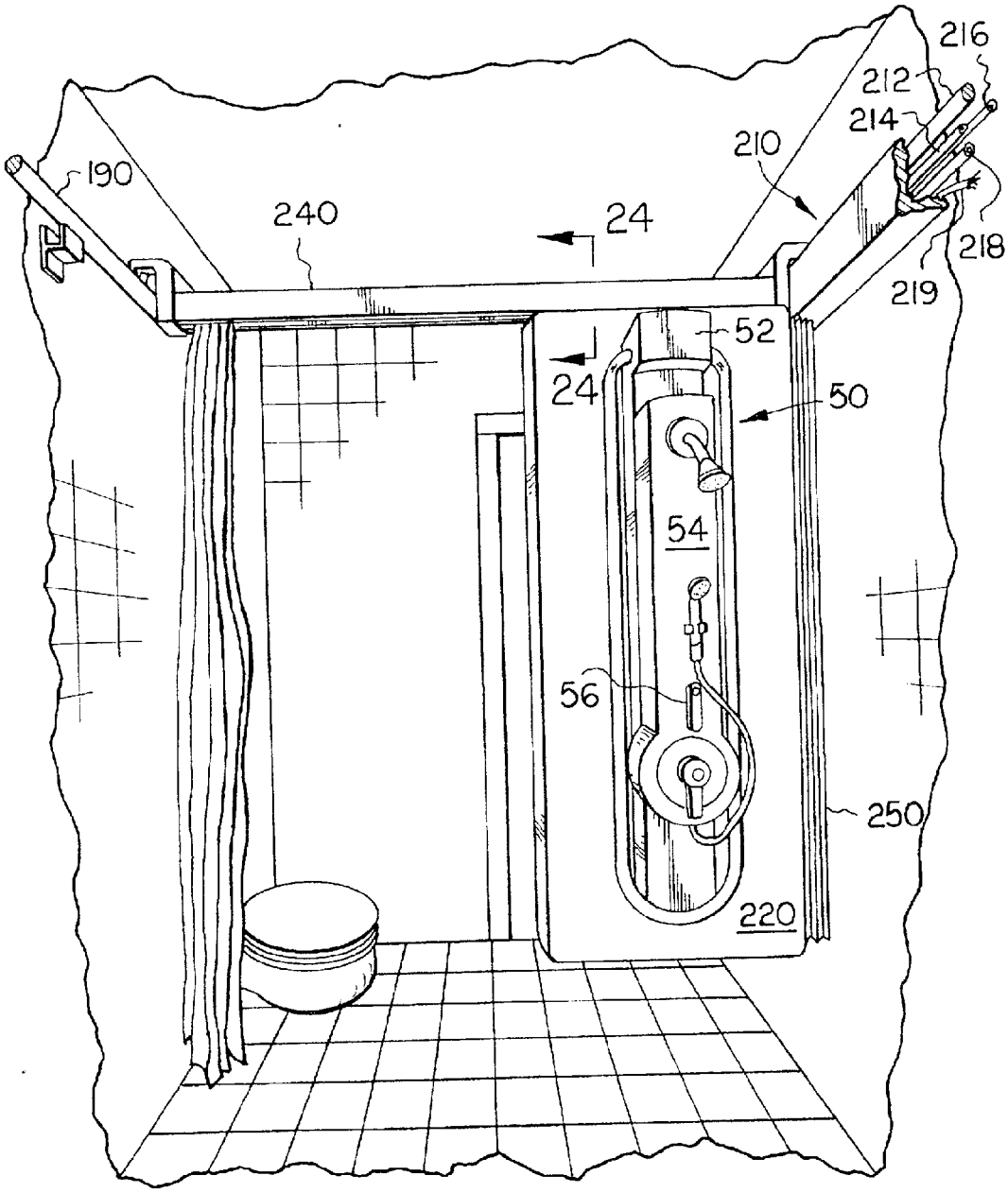
FIG. 19 is a perspective view of the opposite side of the movable wall fixture unit shown in FIG. 18.

Shower unit 54 as illustrated in FIG. 19, which is a perspective view of the opposite side of the movable wall fixture unit shown in FIG. 18, can be adjusted vertically by loosening securing bolt 56, in the same manner as the shower fixture in the first embodiment. Bolt 56 is retightened when the desired level is reached.

Supply rail 210, as illustrated in FIG. 19, contains support rail 212 on which wall 200 rolls, hot water supply 214, and cold water supply 216. Water supply lines 214 and 216 provide water to sink fixture 40 and to shower fixture 50. In the preferred embodiment, rails 190 and 212 would be coated with a material such as Teflon® to minimize friction.

FIG. 20 is a front view of the movable wall fixture unit with fixture panel 220 up against the left walL FIG. 21 is a front view of the movable wall fixture unit, showing fixture panel 220 moved horizontally to the right along beam 240. Divider 250, connected between fixture panel 220 and the left wall, unfolds as fixture panel 220 moves toward shower curtain 260 on the right wall. In this position, fixture panel 220 in conjunction with shower curtain 260 protects the rest of the room from the shower water when the shower is in use.

Moving wall 200 on rails 190 and 212, as illustrated in FIG. 19, increases or decreases the available showering area. A change in shower area is illustrated in FIGS. 22 and 23. FIG. 22 is a top view of the movable wall fixture unit positioned at the end of the support rails. In FIG. 22, wall 200 is at the far end of rails 190 and 210, giving the maximum showering space.

FIG. 23 is a top view of the movable wall fixture unit showing the wall rolling on the support rails towards the back of the room. In FIG. 23, wall 200 is rolled along rails 190 and 210 towards the back wall, reducing the amount of space available to shower in.

Figure 24:
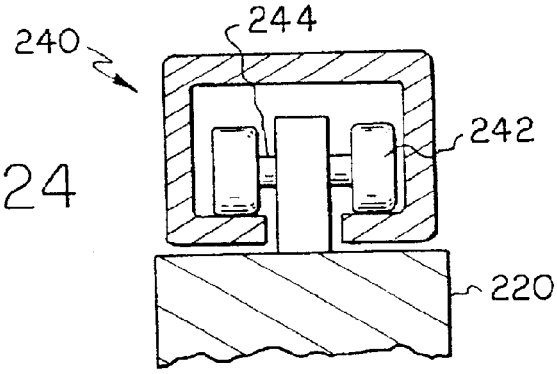
FIG. 24 is a cross-sectional view taken along line 24—24 of FIG. 19 showing the rollers used to move the fixture panel horizontally.

FIG. 24 is a cross-sectional view taken along line 24—24 of FIG. 19 illustrating the rollers used to move the fixture panel horizontally. Beam 240 contains rollers 242 mounted on axles 244. These rollers support panel 220 (best viewed in FIG. 19) and allow it to move horizontally along beam 240.

Figure 25:
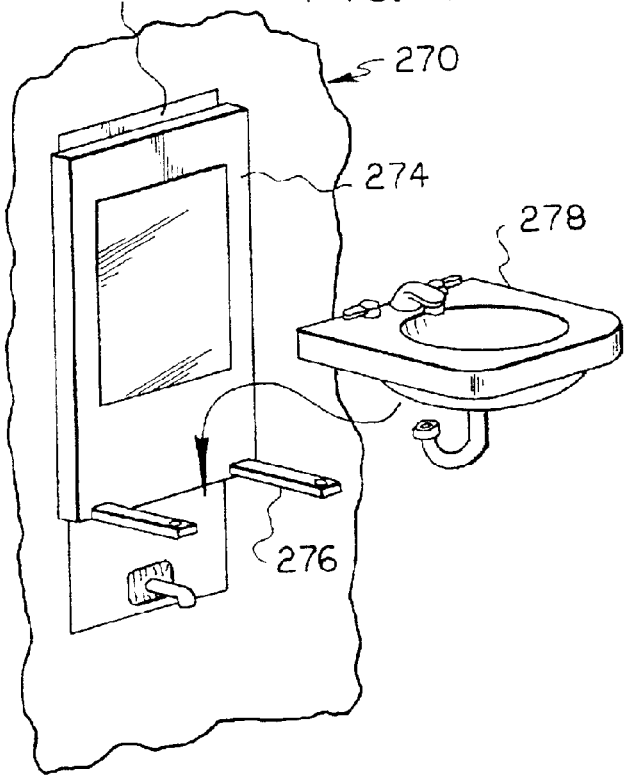
FIG. 25 is a perspective view showing the fourth embodiment, fixture interface units.

FIG. 25 is a perspective view showing the fourth embodiment, fixture interface units. Fixture interface unit 270 provides means to make standard bathroom fixtures adjustable. In the embodiment illustrated, the fixture interface unit includes a fixture holding panel 274 and a fixture holding panel base 272 attached to a wall. Fixture holding panel 274 with removably attached sink fixture 278 is slidably mounted to fixture holding panel base 272. The height of removably attached sink fixture 278 is adjusted by sliding fixture interface unit holding panel 274 either up or down.

Figure 26:
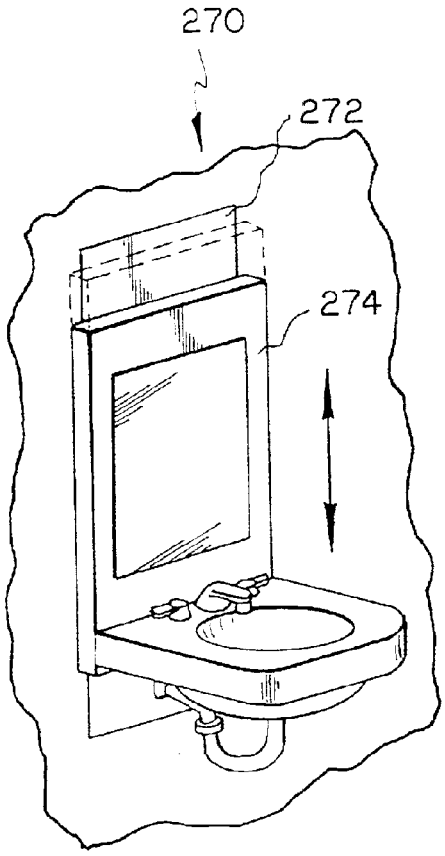
FIG. 26 is a perspective view showing the sink unit being adjusted vertically.

FIG. 26 is a perspective view showing a sink fixture being adjusted vertically to meet the needs of persons of different heights. FIG. 26 shows sink body 278 moving vertically as fixture holding panel 274 is moved vertically with respect to fixture interface holding panel base 272. A counterbalance system (not shown) inside fixture interface body 272 allows the sink fixture to be adjusted in a vertical position and held in the desired position.

Fixture counterbalances offset a part of the weight of the fixtures to make the fixtures easier to lift and to hold the fixtures stationary in various positions along a range of fixture holding panel travel within the boundaries of a fixture interface panel base. The fixture weight is offset by a lifting force that is maintained as uniform as possible throughout the range of fixture travel to minimize opposite conditions of fixture "hop" and fixture "drop". Too much lifting force causes the fixture to undesirably rise or "hop" from a position within the fixture travel range. Too little lifting force allows the fixture to fall or "drop" from a position within the same range. However, friction within the fixture counterbalances and between the fixture holding panel and the fixture holding panel base compensates for some variation in the lifting force by providing a controlled resistance to any movement of the fixture holding panel on its base. Although some friction is desirable to compensate for variations in the lifting force, excessive friction can make the fixture interface unit difficult to move. Accordingly, both the friction and the variations in the is lifting force are limited to obtain optimum overall performance of the fixture interface unit counter-balances. For example, torsion spring balances can be used as fxture interface unit counterbalances to provide a nearly uniform amount of lifting force throughout the range of fixture interface travel.

In addition to offering means for adjusting the height of the sink fixture, the fixture interface unit also offers means to easily replace a fixture so that specific style or color needs can be met. FIG. 25 shows sink fixture 278 being mounted on sink brackets 276 of fiture holding panel 274. Thus, it can readily be appreciated that if the design and/or the color scheme of a room having a fixture interface unit changes, the fixture interface unit allows the present fixture to be replaced, with minimal effort, by one of another style and/or color.

While fixtures of widely differing styles and colors can be selected, the weight of the fixtures should be similar. That is, the weight of the chosen fixture should be appropriate for the weight of the counter balance, so that the fixture can be moved up and down without resistance and with maintaining control of the amount of lift.

Although in this embodiment, the fixture interface unit is illustrated using a sink fixture, it should be obvious to those of ordinary skill in the art that other fixtures can be used with the fixture interface unit, such as a shower fixture, storage unit, lighting system, mirror assembly, wet wall, or a medicine cabinet.

Figure 27:
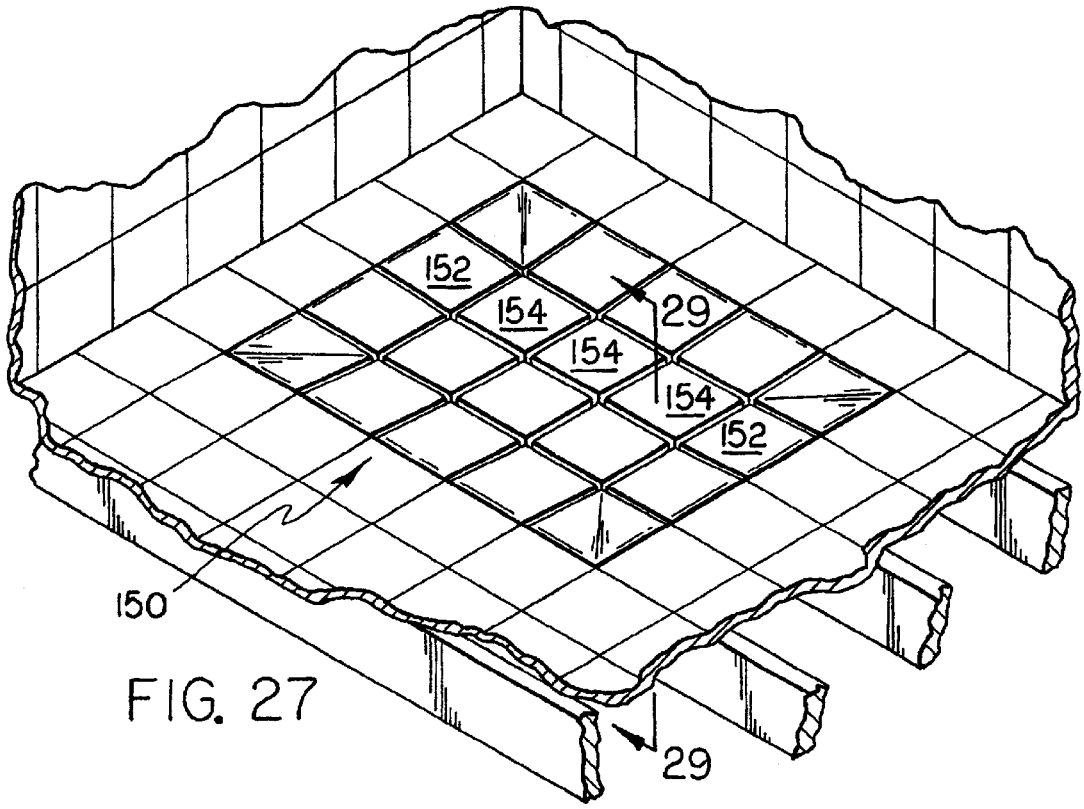
FIG. 27 is a perspective view of the floor drain.

FIG. 27 is a perspective view of the floor drain 150 constructed of end drain tile pieces 152 and central drain tile pieces 154.

Figure 28:
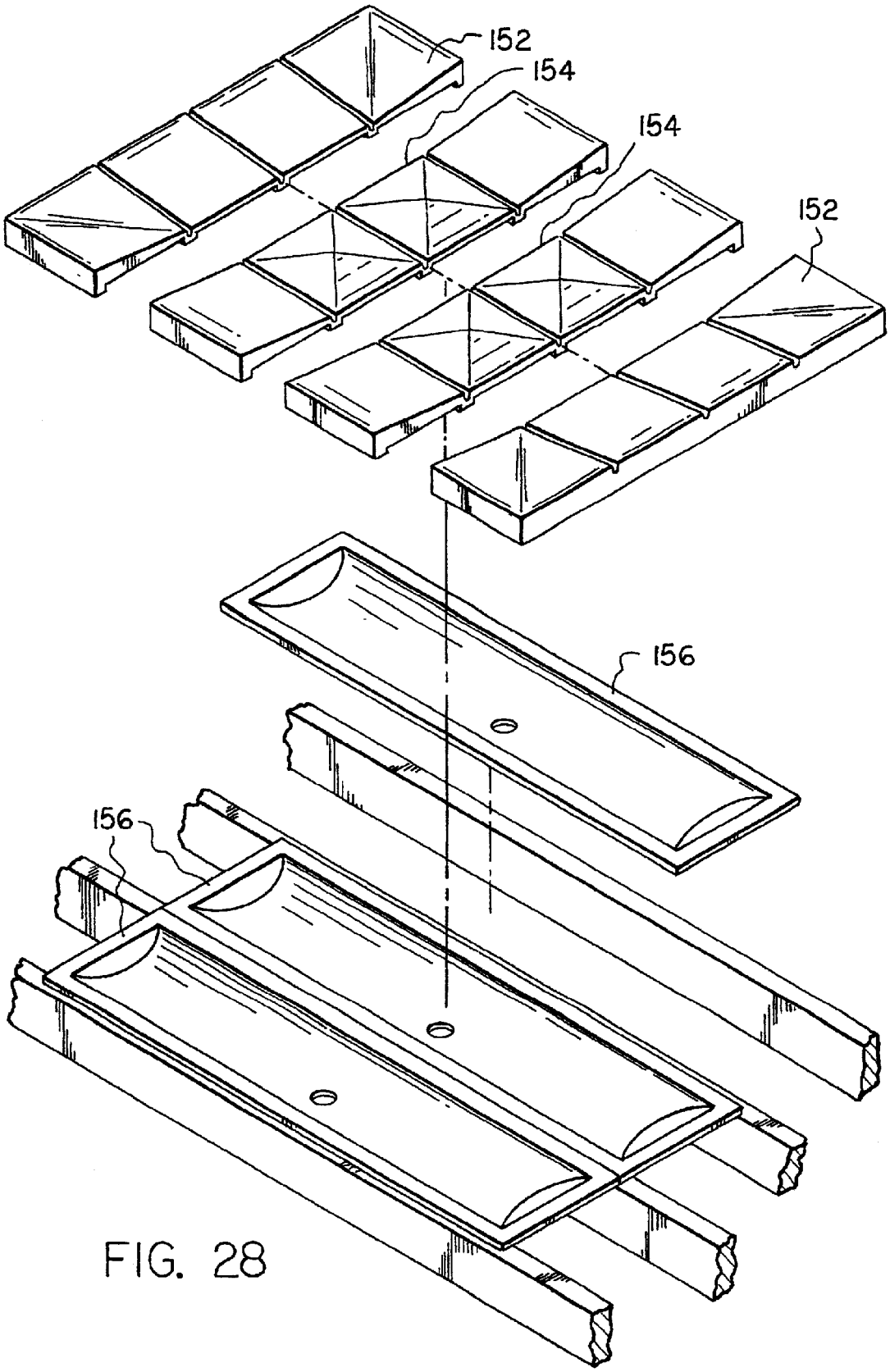
FIG. 28 is a perspective exploded view of the floor drain tiles installed over the floor drain basins.

FIG. 28 is a perspective exploded view of the floor drain tiles installed over the floor drain basins showing floor drain 150 (as illustrated in FIG. 27) having one end tile piece 152 at each end, and as many central tile pieces 154 as necessary to build the drain length desired.

Figure 29:
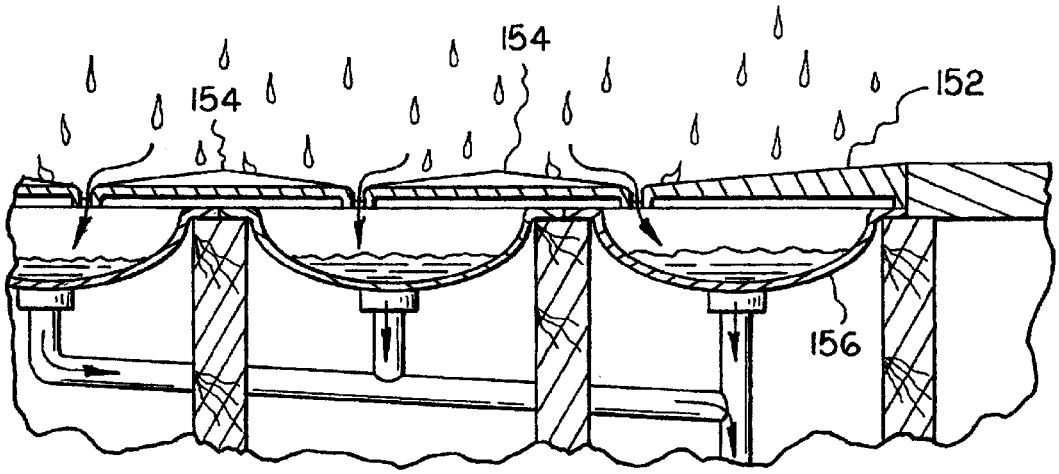
FIG. 29 is a cross-sectional view taken along line 29—29 of FIG. 27 showing the floor drain tiles installed over the floor drain basins.

FIG. 29 is a cross-sectional view taken along line 29—29 of FIG. 27 showing floor drain 150 installed over drain basins 156.

As is well known, a problem with conventional present-day toilets is that they all for the most part, share common dimensions. That is, almost all toilet seats are positioned at approximately the same height above the floor. Conventional toilet seats, then, are not especially accommodating for short people, tall people, children, disabled people, etc. The present invention uniquely addresses this problem by providing an adjustable toilet seat that offers height adjustment.

Figure 30:
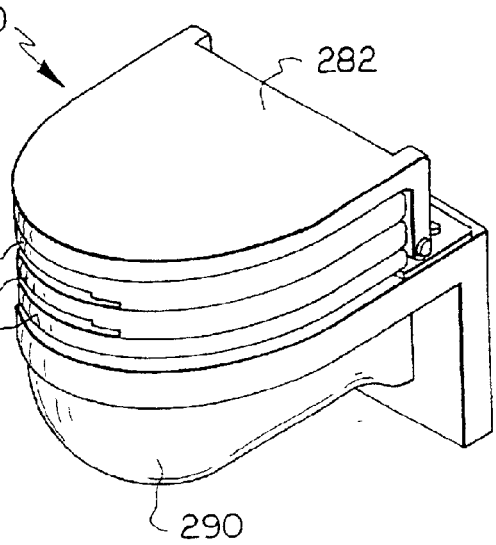
FIG. 30 is a perspective view of the adjustable toilet seat with the cover down.

FIG. 30 is a perspective view of adjustable toilet seat 280 with the toilet seat cover 282 down. Cover 282 is the top level, hinged with multiple seats (284, 286, 288) on the toilet body 290.

Figure 31:
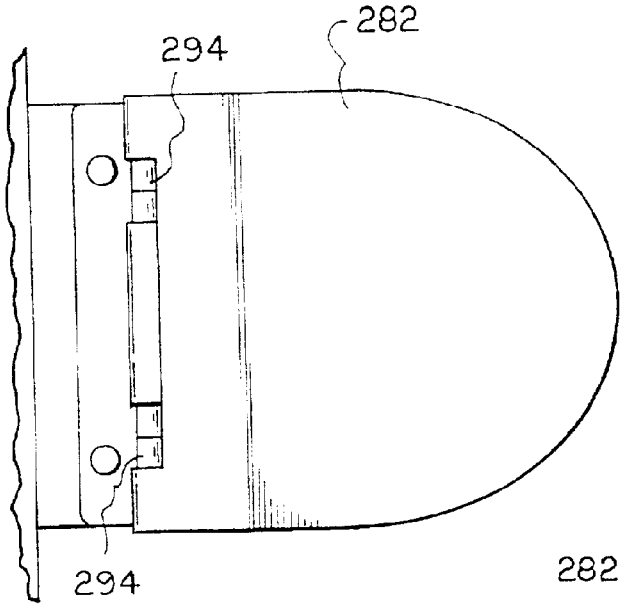
FIG. 31 is an orthographic top view of the adjustable toilet seat with the cover down.
Figure 32:
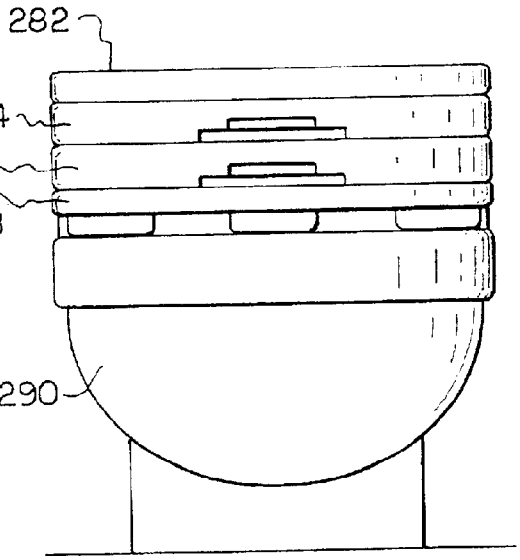
FIG. 32 is an orthographic front view of the adjustable toilet seat with the cover down.
Figure 38:
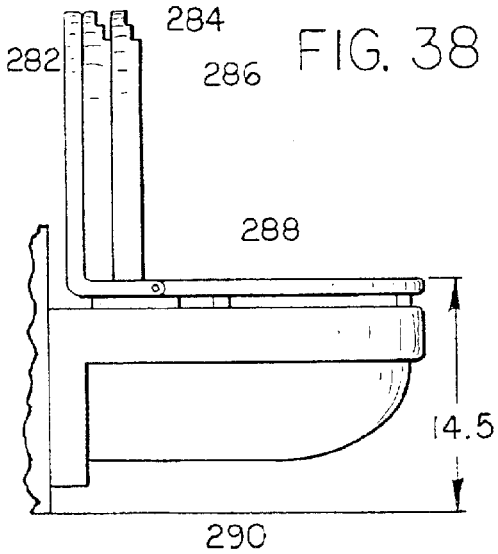
FIG. 38 is an orthographic side view of the adjustable toilet seat with the second seat up.
Figure 39:
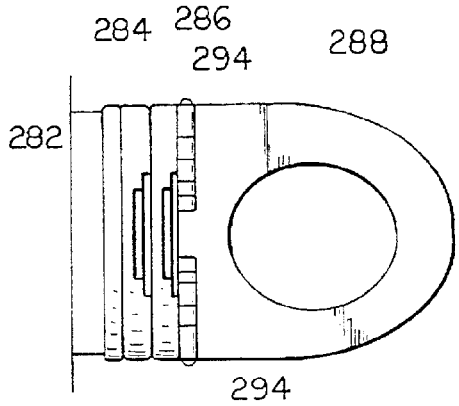
FIG. 39 is an orthographic top view of the adjustable toilet seat with the second seat up; and, FIG. 40 is an exploded perspective view of the adjustable toilet seat hinge.

FIG. 31 is a top view of the adjustable toilet seat 280 with cover 282 down. FIG. 32 is a front view of the adjustable toilet seat 280 with cover down. FIG. 33 is the rear view of toilet 280 with cover 282 down. FIG. 34 is a side view of adjustable toilet seat 280 with cover 282 up. FIG. 35 is a top view of adjustable toilet seat 280 with cover 282 up. FIG. 36 is a side view of adjustable toilet seat 280 with first seat 284 up. FIG. 37 is a top view of adjustable toilet 280 seat with first seat 284 up. FIG. 38 is a side view of adjustable toilet seat 280 with second seat 286 up. FIG. 39 is a top view of adjustable toilet seat 280 with second seat 286 up. The third seat 288 is down in all these figures.

Figure 40:
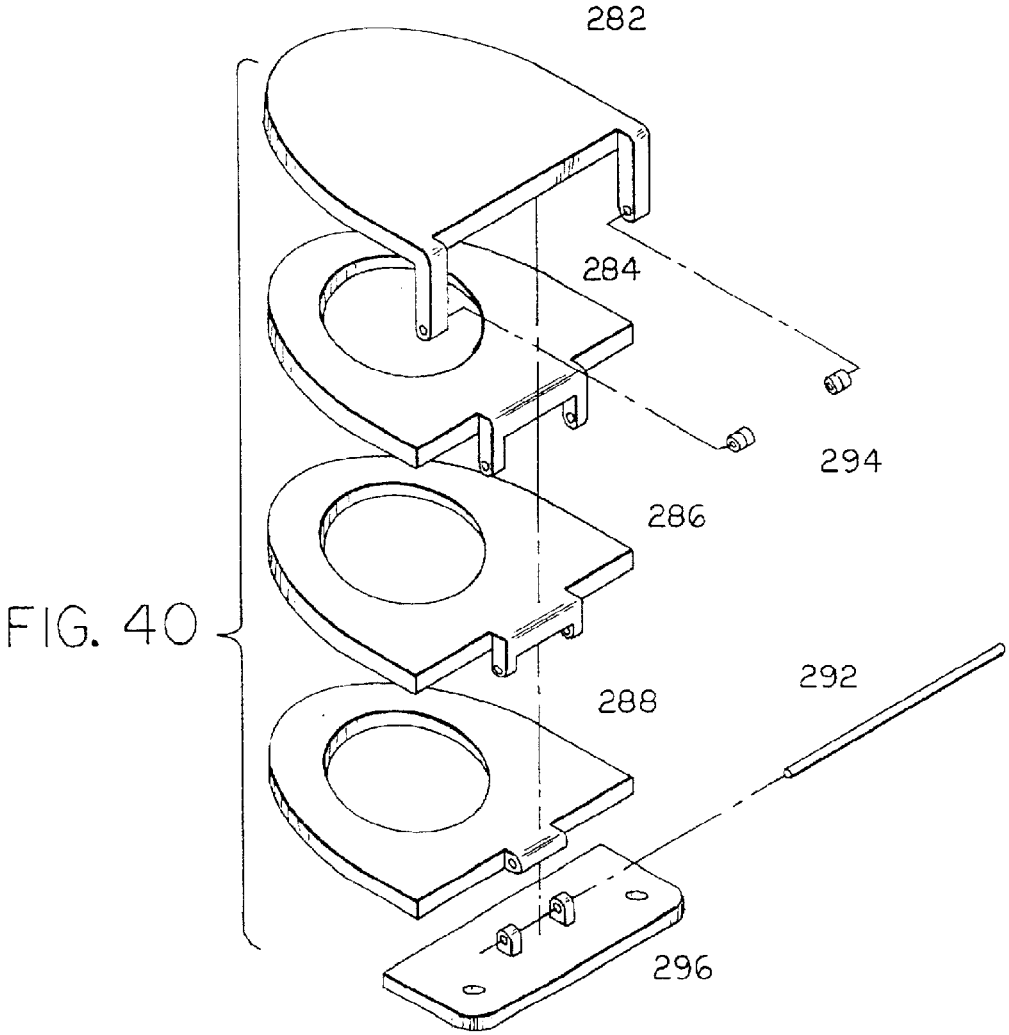

FIG. 40 is an exploded perspective view of the adjustable toilet seat hinge. Rod 292 is threaded through hinge eyelets 296, eyelets 282 on cover, eyelets (284, 286, 288), on all the seats and spacers 294.

Thus, it is seen that the objects of the present invention are efficiently attained, although it should be readily apparent to those having ordinary skill in the art that changes and modifications to the invention as disclosed herein can be made without departing from the spirit or scope of the present invention as claimed. For example, kitchen garage, basement, nursery room, fixtures could be used, as well as, in place of, or in addition to bathroom fixtures.

What is claimed is:

1. A movable sink fixture secured to a wall, comprising:

a) a sink, wherein said sink is formed within said moveable sink fixture;

b) means for vertically moving said sink with respect to said wall;

c) means for moving said sink fixture horizontally with respect to said wall, wherein said horizontal moving means is operatively arranged to maintain an immutable distance between said sink and said wall; and, d) means for locking said sink fixture in place once said sink fixture has been moved to a desired location with respect to said wall.

2. The movable sink fixture as recited in claim 1, wherein the means for moving said sink fixture horizontally with respect to said wall comprises:

a) at least two support rails fixedly attached to said wall; and, b) a fixture base;

wherein said sink fixture is slidably secured to said fixture base which is slidably connected to said at least two support rails.

3. The movable sink fixture as recited in claim 1, wherein the means for locking said sink fixture in place once said sink fixture has been moved to a desired location with respect to said wall comprises a securing bolt assembly.

* * * * *